US009103083B1

(12) United States Patent
Roland

(10) Patent No.: US 9,103,083 B1
(45) Date of Patent: Aug. 11, 2015

(54) HANDI SCOOP SYSTEM

(71) Applicant: David Roland, Menifee, CA (US)

(72) Inventor: David Roland, Menifee, CA (US)

( * ) Notice: Subject to any disclaimer, the term of this patent is extended or adjusted under 35 U.S.C. 154(b) by 0 days.

(21) Appl. No.: 14/598,069

(22) Filed: Jan. 15, 2015

Related U.S. Application Data

(60) Provisional application No. 61/929,850, filed on Jan. 21, 2014.

(51) Int. Cl.
*A01K 29/00* (2006.01)
*E01H 1/12* (2006.01)

(52) U.S. Cl.
CPC ..... *E01H 1/1206* (2013.01)

(58) Field of Classification Search
CPC ..... E01H 1/1206; A01B 1/02; A01K 23/005; A01K 1/0107; A47L 13/52; A01G 1/12
USPC ..... 294/1.3; D7/691; D30/162
See application file for complete search history.

(56) References Cited

U.S. PATENT DOCUMENTS 3,986,744 A * 10/1976 Krogstad et al. ..... 294/1.3
4,047,746 A 9/1977 Radowski
4,138,153 A * 2/1979 Brown ..... 294/1.4
4,149,745 A * 4/1979 Willis ..... 294/1.4
4,917,238 A * 4/1990 Schumacher ..... 206/223
5,540,469 A 7/1996 Albert
5,868,447 A * 2/1999 Clark et al. ..... 294/1.4
7,278,377 B1 10/2007 Stephens
2009/0058114 A1* 3/2009 Diehl ..... 294/1.4
2009/0072559 A1* 3/2009 Wilkerson ..... 294/1.4
2009/0315349 A1* 12/2009 Black et al. ..... 294/1.3
2010/0117387 A1* 5/2010 Axelrod ..... 294/1.4
2012/0080894 A1* 4/2012 Williamson ..... 294/1.4

* cited by examiner

*Primary Examiner* — Stephen Vu
(74) *Attorney, Agent, or Firm* — RG Patent Consulting, LLC; Rachel Gilboy

(57) ABSTRACT

An animal excrement collection system includes an animal excrement collection assembly having a hollow scooper device including a base having a flat tapered blade, a first curved upward first side wall, and a second curved upward second side wall; a cylindrical shaped open-ended collection receptacle having a body with a through-hole, at least two fasteners, and a handle; and a storage bag. The animal excrement collection system prevents the user from coming into contact with the animal excrement by scooping the animal excrement and dropping the animal excrement directly into the storage bag via the through-hole of the body thereby providing a sanitary means for preventing direct contact with the animal excrements.

14 Claims, 5 Drawing Sheets

HANDI SCOOP SYSTEM

CROSS-REFERENCE TO RELATED APPLICATION

The present application is related to and claims priority from prior provisional application Ser. No. 61/929,850, filed Jan. 21, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of animal waste scooping and bagging devices and more specifically relates to an animal excrement collection system.

2. Description of the Related Art

Many people in modern society have pets such as dogs. Although a dog is a delightful addition to any family, cleaning up after them can be unpleasant at best. Specifically, collecting and disposing of waste matter is an unsettling task, however, most conscientious dog owners realize that it is one which must be done. In particular, those who live in cities and suburban areas are required by laws and local ordinances to remove dog waste from sidewalks and lawns immediately after the animal has answered the call of nature. For those who live in less populated areas, removing pet waste is a key factor in maintaining an attractive and well-kept yard. Most people collect their dog's waste in either a plastic bag or tissue.

Unsanitary and disagreeable, picking up waste matter by hand can be a daunting job. Most consumers pick up animal waste by placing a bag over their hand and then lifting the waste off the ground manually. The user can then pull the bag over the fecal matter, lifting the bag off the hand and dropping the waste directly within. As can be imagined however, collecting waste in this fashion can be extremely unpleasant. Not only does one have to contend with the unpleasant sensation of handling waste matter directly, but should there be a hole or tear in the bag, one risks actually touching the waste, resulting in feces on the hand and spreading harmful germs and bacteria in the process.

Various attempts have been made to solve problems found in animal waste scooping and bagging devices art. Among these are found in: U.S. Pat. No. 5,540,469 to Larry L. Albert; U.S. Pat. No. 7,278,377 to Chris Stephens; and U.S. Pat. No. 4,047,746 to Stanley P. Radowski. This prior art is representative of animal waste scooping and bagging devices. None of the above inventions and patents, taken either singly or in combination, is seen to describe the invention as claimed.

Ideally, an animal excrement collection system would be user-friendly and safe in-use and, yet may operate reliably and be manufactured at a modest expense. Thus, a need exists for an animal excrement collection system that is structured and arranged to prevent a user from coming into contact with animal excrements and to avoid the above-mentioned problems.

BRIEF SUMMARY OF THE INVENTION

In view of the foregoing disadvantages inherent in the known animal waste scooping art, the present invention provides a novel animal excrement collection system (also referred to herein as 'Handi Scoop System'). The general purpose of the present invention, which will be described subsequently in greater detail is to provide an animal excrement collection system that is structured and arranged to prevent a user from coming into contact with animal excrements by scooping the animal excrement and dropping the animal excrement directly into a storage bag via a through-hole of a body thereby providing a sanitary means for preventing direct contact with the animal excrements.

An animal excrement collection system is disclosed herein in a preferred embodiment comprising: an animal excrement collection assembly having a hollow scooper device including a base having a flat tapered blade, a first curved upward first side wall, and a second curved upward second side wall; a cylindrical shaped open-ended collection receptacle having a body with a through-hole, at least two fasteners, and a handle; and a storage bag. The animal excrement collection system comprises the animal excrement collection assembly. The animal excrement collection assembly comprises the hollow scooper device, the cylindrical shaped open-ended collection receptacle, and the storage bag in functional combination. The animal excrement collection system is structured and arranged to prevent the user from coming into contact with the animal excrement by scooping the animal excrement and dropping the animal excrement directly into the storage bag via the through-hole of the body thereby providing a sanitary means for preventing direct contact with the animal excrements.

The animal excrement collection assembly comprises molded plastic for strength, durability, and ease of cleaning the base and the cylindrical shaped open-ended collection receptacle. The cylindrical shaped open-ended collection receptacle is preferably integral with the base. The cylindrical shaped open-ended collection receptacle is approximately fl-inches in length and 6-inches in diameter which is sufficiently sized to provide unimpeded movement (travel) of the animal excrements through the hollow scooper device into the storage bag. The at least two fasteners comprise spring-loaded clips for removeably-coupling the storage bag in place and preventing unwanted displacement when scooping up the animal excrements.

The flat tapered blade acts as a ramp for permitting scooping of the animal excrements from a planar surface for disposal. The flat tapered blade is flat and triangular in shape for ease of scooping up the animal excrements without the user coming into contact with the animal excrements. The flat tapered blade may be approximately 6-inches in width and 4½ inches in length. The flat tapered blade is triangular in shape. The flat tapered blade further comprises a plurality of indents. The plurality of indents comprise teeth for ease in isolating and scooping up of the animal excrements from the planar surface. The first curved upward first side wall and the second curved upward second side wall act as a collector of the animal excrements animal excrements comprise feces.

The handle is integral to and centrally located on a top of the cylindrical shaped open-ended collection receptacle. The handle permits a user to grasp the animal excrement collection assembly and scoop up the animal excrements. The handle extends an entire length of the cylindrical shaped open-ended collection receptacle. The handle is curved upward to provide a smooth area for the hand of the user to grip during an in-use condition.

The storage bag is removably-couplable via the at least two fasteners to the cylindrical shaped open-ended collection receptacle for collecting the animal excrements. The storage bag is disposable with the storage bag being removable from the animal excrement collection system, once filled, and disposed of thereby preventing spread of germs and diseases found in the animal excrements. The storage bag is biodegradable. The storage bag is approximately 11-inches in width and 14 inches in length dimensioned to fit over the cylindrical shaped open-ended collection receptacle.

A kit is also embodied herein for the animal excrement collection system including: at least one animal excrement collection assembly; a plurality of storage bags; and a set of user-instructions.

A method of use for the animal excrement collection system is disclosed herein comprising the steps of: locating a disposable storage bag for use specifically with an animal excrement collection assembly; inserting the disposable storage bag onto the cylindrical shaped open-ended collection receptacle; removably-coupling the disposable storage bag via at least two spring-loaded clips to the cylindrical shaped open-ended collection receptacle; an animal defecating; a user placing the animal excrement collection assembly next to feces; the user scooping up the feces via the flat tapered bade; the feces dropping into the disposable storage bag; un-clipping the disposable storage bag with the feces therein; removing the disposable storage bag; and disposing of the disposable storage bag into a trash receptacle. The method further comprising the steps of washing the animal excrement collection system to remove germs and bacteria from scooping up said feces for future use.

The present invention holds significant improvements and serves as an animal excrement collection system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, animal excrement collection system (entitled Handi Scoop System) constructed and operative according to the teachings of the present invention.

The various embodiments of the present invention will hereinafter be described in conjunction with the appended drawings, wherein like designations denote like elements.

DETAILED DESCRIPTION

Figure 1:
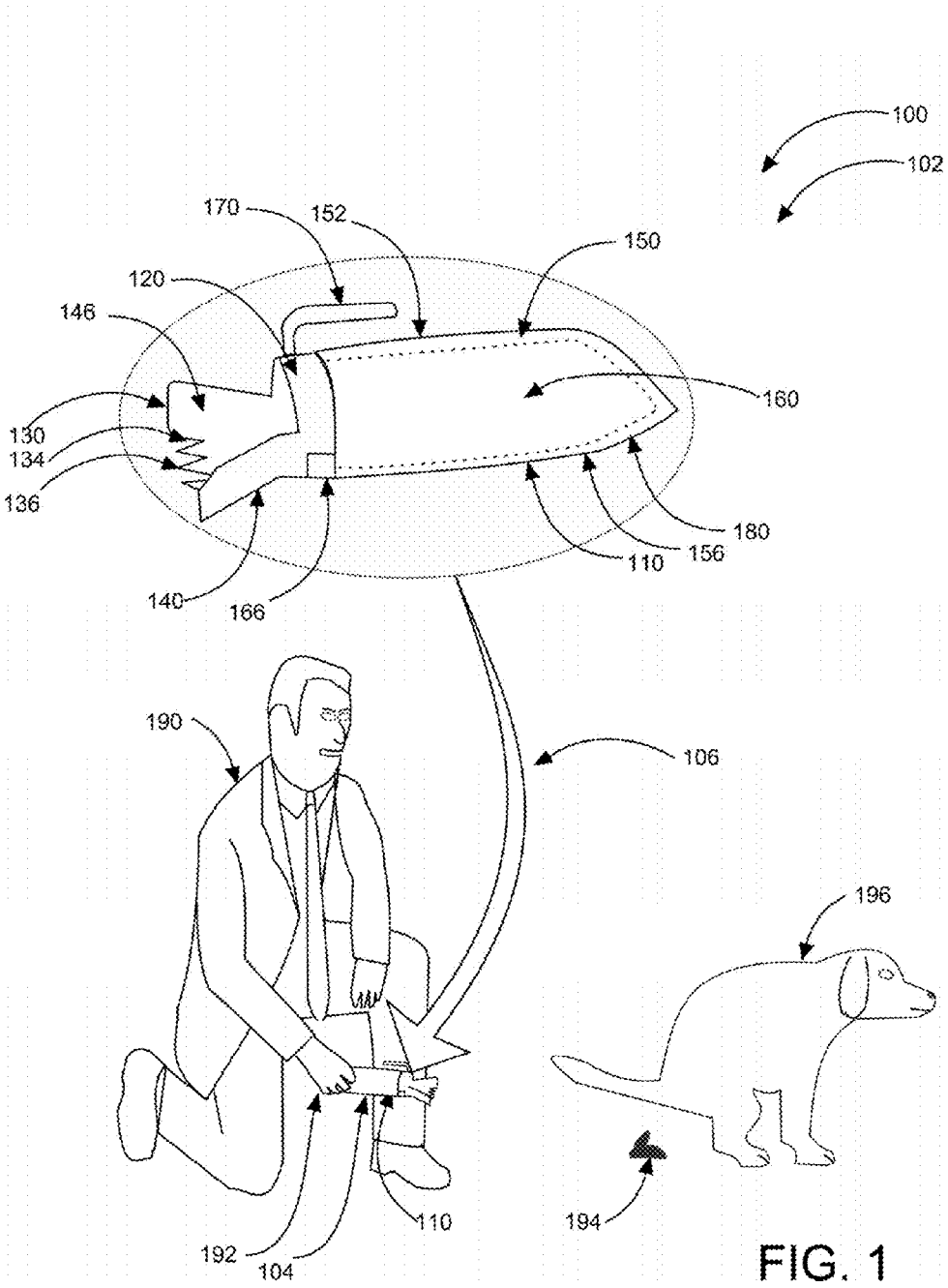
FIG. 1 shows a perspective view illustrating an animal excrement collection system in an in-use condition according to an embodiment of the present invention.

As discussed above, embodiments of the present invention relate to a animal waste scooping and bagging devices and more particularly to an animal excrement collection system (also referred to herein as 'Handi Scoop Systems') that is structured and arranged to prevent a user from contacting the animal excrements.

Generally speaking, animal excrement collection system comprises a specially designed pet waste collection device, specifically configured to enable users to collect waste without making direct contact with fecal matter. The Handi Scoop System may be manufactured primarily of molded plastic material and may be a comprised of a shovel like scoop, on the base of which a cylindrical shaped and open ended collection receptacle may be integrally attached. Designed to be utilized in conjunction with a plastic collection bag, the Handi Scoop system may be configured so that one may scoop the waste matter and drop it directly into the bag without making direct contact.

The scoop portion of the Handi Scoop System may be similar in configuration to a small shovel or dust pan and may be a flat, triangular shaped unit measuring approximately 6 inches in width and 4.5 inches in length. This scoop may comprise raised side walls on either side of the scoop that may serve to contain waste matter within, while the front end of the scoop may be tapered to facilitate the easy retrieval of waste. Attached to the base of this scoop may be the actual collection receptacle: a cylindrical shaped, open ended unit measuring 8 inches in length and 6 inches in diameter. A sturdy handle may be mounted to the top of the unit and may be centrally positioned, running the length of the actual collection reservoir. Notably, attached to either side of the scoop may be sturdy, spring loaded clip fasteners, with which a biodegradable waste collection bag may be secured.

Biodegradable plastic collection bags measuring an ample 11 inches in width and 14 inches in length may be included for sale with the unit, with additional bags sold separately. Providing a clean and practical method of collection, the Handi Scoop System may make this unpleasant task simple, quick, hands free and thus, more sanitary.

Referring now to the drawings by numerals of reference there is shown in FIGS. 1-4 perspective views illustrating animal excrement collection assembly 102 of animal excrement collection system 100 according to an embodiment of the present invention.

Animal excrement collection system 100 comprises: animal excrement collection assembly 102 having hollow scooper device 110 including base 120 having flat tapered blade 130, first curved upward first side wall 140, and second curved upward second side wall 146; cylindrical shaped open-ended collection receptacle 150 having body 156 with through-hole 160, a back end flat platform 175, at least two fasteners 166, and handle 170; and storage bag 180. Animal excrement collection system 100 comprises animal excrement collection assembly 102. Animal excrement collection assembly 102 comprises hollow scooper device 110, cylindrical shaped open-ended collection receptacle 150, and storage bag 180 in functional combination.

Animal excrement collection system 100 is structured and arranged to prevent user 190 from coming into contact with animal excrement 194 by scooping animal excrement 194 and dropping animal excrement 194 directly into storage bag 180 via through-hole 160 of body 156 thereby providing a sanitary means for preventing direct contact with animal excrements 194 as shown in in-use condition 106 of FIG. 1. Animal excrement collection assembly 102 comprises molded plastic for strength, durability, and ease of cleaning base 120 and cylindrical shaped open-ended collection receptacle 150. Upon reading this specification, it should be appreciated that, under appropriate circumstances, considering such issues as user preferences, design preference, structural requirements, marketing preferences, cost, available materials, technological advances, etc., other material arrangements such as, for example, rubber, metal, non-metal, etc., may be sufficient.

Figure 2A:
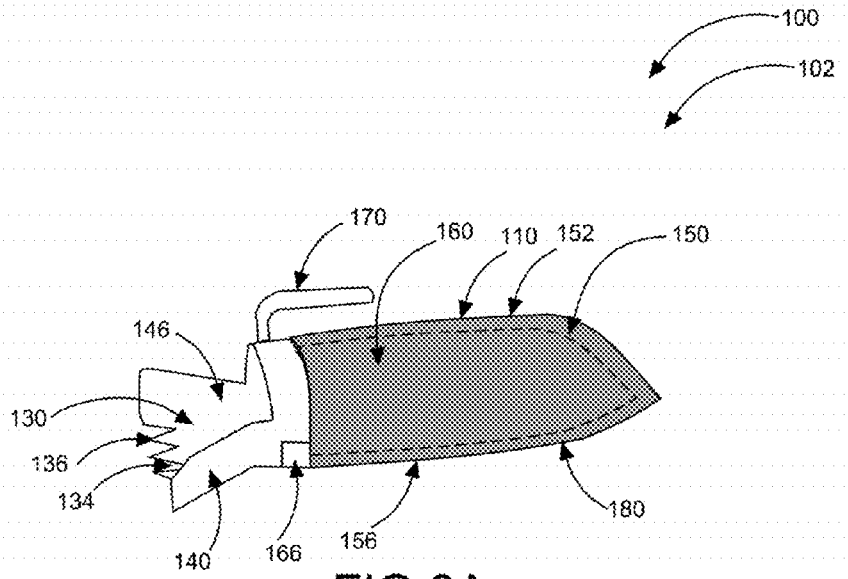
FIG. 2A is a perspective view illustrating an animal excrement collection assembly of the animal excrement collection system according to an embodiment of the present invention of FIG. 1.
Figure 2B:
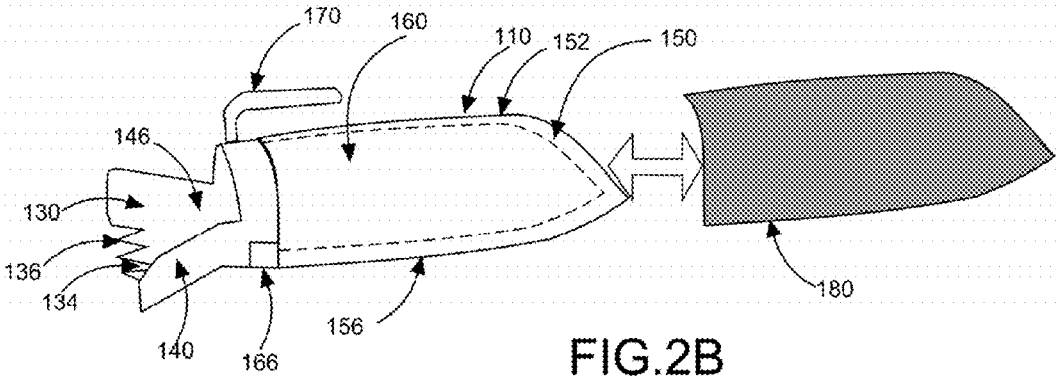
FIG. 2B is a perspective view illustrating an animal excrement collection assembly of the animal excrement collection system according to an embodiment of the present invention of FIG. 1.
Figure 3:
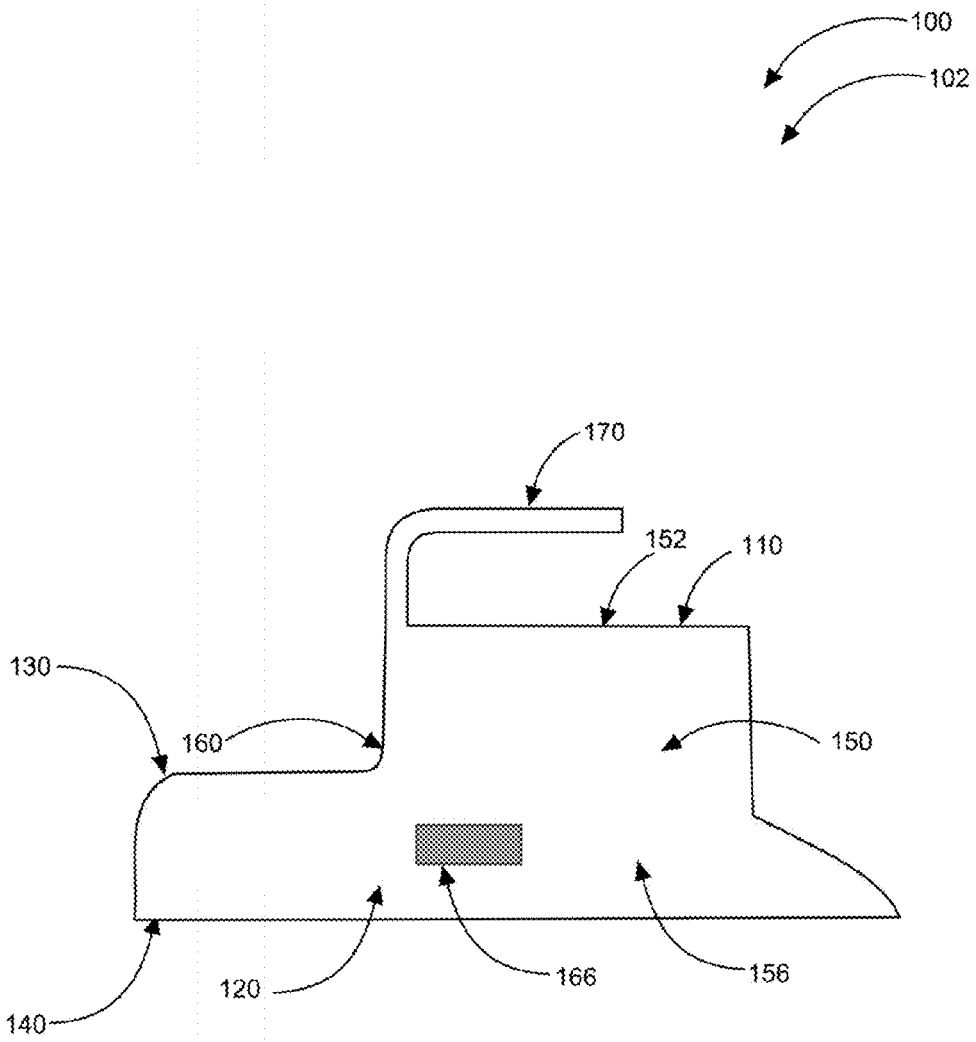
FIG. 3 is a perspective view illustrating the animal excrement collection assembly of the animal excrement collection system according to an embodiment of the present invention of FIG. 1.
Figure 4A:
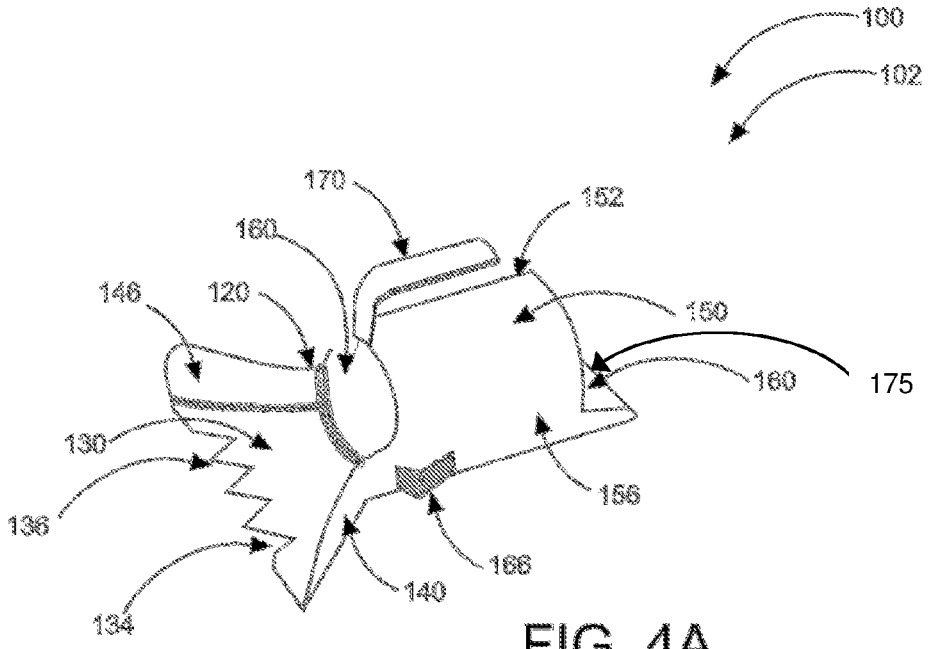
FIG. 4A is a perspective view illustrating the animal excrement collection assembly of the animal excrement collection system according to an embodiment of the present invention of FIG. 1.
Figure 4B:
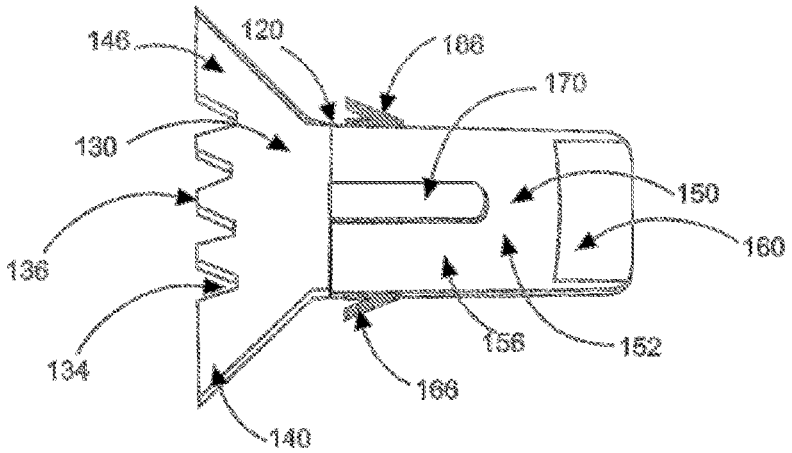
FIG. 4B is a perspective view illustrating the animal excrement collection assembly of the animal excrement collection system according to an embodiment of the present invention of FIG. 1.

Cylindrical shaped open-ended collection receptacle 150 is integral with base 120. Cylindrical shaped open-ended collection receptacle 150 is approximately 8-inches in length and 6-inches in diameter which is sufficiently sized to provide unimpeded movement of animal excrements 194 through hollow scooper device 110 into storage bag 180. At least two fasteners 166 comprises spring-loaded clips for removeably-coupling storage bag 180 in place and preventing unwanted displacement when scooping up animal excrements 194 as shown in FIGS. 2A and 2B. Upon reading this specification, it should be appreciated that, under appropriate circumstances, considering such issues as user preferences, design preference, structural requirements, marketing preferences, cost, available materials, technological advances, etc., other fastener arrangements such as, for example, clamps, hook and loops fasteners, adhesives, etc., may be sufficient.

Flat tapered blade 130 acts as a ramp for permitting scooping of animal excrements 194 from planar surface 104 for disposal. Flat tapered blade 130 is triangular in shape. Flat tapered blade 130 is flat and triangular in shape for ease of scooping up animal excrements 194 without user 190 coming into contact with animal excrements 194. Flat tapered blade 130 is approximately 6-inches in width and 4½ inches in length. Flat tapered blade 130 further comprises plurality of indents 134. Plurality of indents 134 comprise teeth 136 for isolating and scooping up of animal excrements 194 from planar surface 104. First curved upward first side wall 140 and second curved upward second side wall 146 act as a collector of animal excrements 194. Animal excrements 194 comprise feces.

Handle 170 is integral to and preferably centrally located on top 152 of cylindrical shaped open-ended collection receptacle 150. Handle 170 permits a user to grasp animal excrement collection assembly 102 and scoop up animal excrements 194. Handle 170 may extend an entire length of cylindrical shaped open-ended collection receptacle 150. Handle 150 is curved upward to provide a smooth area for hand 192 of user 190 to grip during in-use condition 106 as shown in FIG. 1. The back end flat platform 175 is shaped as such to ensure that the animal excrements proceeds downwardly into an attached storage bag without contacting an adjacent portion of the storage bag before landing in a bottom portion thereof. This is advantageous in avoiding extraneous excrements touching an underside of the back end of the collection receptacle, and ensures that most of the excrements will end up at the bottom most portion of the storage back for easier removal, sealing, and disposal.

Storage bag 180 is removably-couplable via at least two fasteners 166 to cylindrical shaped open-ended collection receptacle 150 for collecting animal excrements 194. Storage bag 180 is disposable with storage bag 180 being removable from animal excrement collection system 100, once filled, and disposed of thereby preventing spread of germs and diseases found in animal excrements 194. Storage bag 180 may be reusable in an alternate embodiment and may be washable. Storage bag 180 is biodegradable. Storage bag 180 is approximately 11-inches in width and 14 inches in length dimensioned to fit over cylindrical shaped open-ended collection receptacle 150.

Animal excrement collection system 100 may be sold as a kit (not shown) comprising the following parts: at least one animal excrement collection assembly 102; a plurality of storage bags 180; and a set of user-instructions. The kit has instructions such that functional relationships are detailed in relation to the structure of the invention (such that the invention can be used, maintained, or the like in a preferred manner) Animal excrement collection system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different fastening combinations, parts may be sold separately, etc., may be sufficient.

Figure 5:
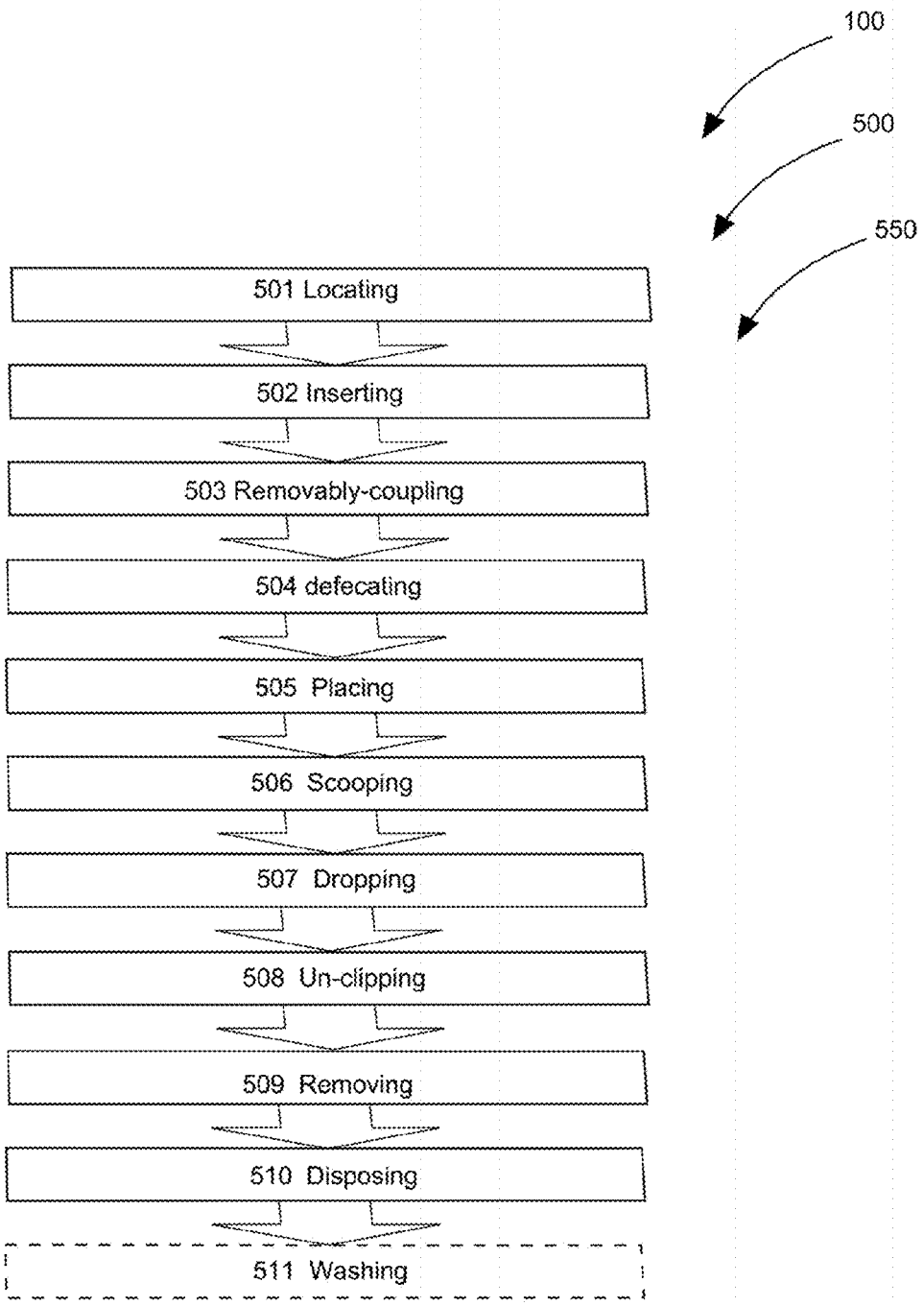
FIG. 5 is a flowchart illustrating a method of use for the animal excrement collection system according to an embodiment of the present invention of FIGS. 1-4.

Referring now to FIG. 5, flowchart 550 illustrating method of use 500 for animal excrement collection system 100 according to an embodiment of the present invention of FIGS. 1-4.

Method of using (method of use 500) animal excrement collection system 100 comprises the steps of: step one 501 locating disposable storage bag 180 for use specifically with animal excrement collection assembly 102; step two 502 inserting disposable storage bag 180 onto cylindrical shaped open-ended collection receptacle 150; step three 503 removably-coupling disposable storage bag 180 via at least two spring-loaded clips (at least two fasteners 166) to cylindrical shaped open-ended collection receptacle 150; step four 504 animal 196 defecating; step five 505 user 190 placing animal excrement collection assembly 102 next to animal excrement 194; step six 506 user 190 scooping up feces (animal excrement 194) via flat tapered bade 130; step seven 507 feces (animal excrement 194) dropping into disposable storage bag 180; step eight 508 un-clipping disposable storage bag 180 with feces (animal excrements 194) therein; step nine 509 removing disposable storage bag 180; and step ten 510 disposing of disposable storage bag 180 into a trash receptacle. The method may further comprise the steps of step eleven 511 washing animal excrement collection system 100 to remove germs and bacteria from scooping up feces (animal excrements 194) for future use.

It should be noted that step 511 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An animal excrement collection system comprising:

an animal excrement collection assembly having, a hollow scooper device including, a base having, a flat tapered blade, a first curved upward first side wall, and a second curved upward second side wall;

a cylindrical shaped open-ended collection receptacle having, a body with a through-hole extending along a length thereof, wherein said body has a proximal end adjacent said base, and a distal end opposite from said proximal end:

wherein said flat tapered blade extends outwardly from a bottom portion of said collection receptacle adjacent said through hole, and said first curved upward first side wall and said second curved upward second side wall extend outwardly from opposite sides of said collection receptacle adjacent said through-hole and connected on respective side edges to respective opposite side edges of said flat tapered blade;

wherein said flat tapered blade, said first curved upward first side wall, and said second curved upward second side wall together form a tapered volume adapted to guide animal excrements along a top surface of said flat tapered blade and through said through hole at said proximal end of said body;

at least two fasteners attached to opposite sides of said collection receptacle adjacent said proximal end thereof, and a handle attached to said collection receptacle adjacent said proximal end thereof;

a back end flat platform, wherein said back end flat platform extends outwardly from said bottom portion of said collection receptacle adjacent said distal end thereof, said back end flat platform adapted to ensure that animal excrements proceed from said body, along said flat platform, and downwardly into an attached storage bag without contacting an adjacent portion of said storage bag before landing in a bottom portion thereof; and a storage bag;

wherein said cylindrical shaped open-ended collection receptacle is integral with said base;

wherein said flat tapered blade acts as a ramp for permitting scooping of said animal excrements from a planar surface for disposal;

wherein said handle is integral to and centrally located on a top of said cylindrical shaped open-ended collection receptacle;

wherein said handle permits a user to grasp said animal excrement collection assembly and scoop up said animal excrements;

wherein said storage bag is removably-couplable via said at least two fasteners to said cylindrical shaped open-ended collection receptacle for collecting said animal excrements; and wherein said animal excrement collection system is structured and arranged to prevent said user from coming into contact with said animal excrement by scooping said animal excrement and dropping said animal excrement directly into said storage bag via said through-hole of said body thereby preventing direct contact with said animal excrements.

2. The animal excrement collection system of claim 1 wherein said animal excrement collection assembly comprises molded plastic for strength, durability, and ease of cleaning said base and said cylindrical shaped open-ended collection receptacle.

3. The animal excrement collection system of claim 1 wherein said flat tapered blade is flat and triangular in shape for ease of scooping up said animal excrements without said user coming into contact with said animal excrements.

4. The animal excrement collection system of claim 1 wherein said flat tapered blade is approximately 6-inches in width and 4½ inches in length.

5. The animal excrement collection system of claim 1 wherein said flat tapered blade further comprises a plurality of indents.

6. The animal excrement collection system of claim 5 wherein said plurality of indents comprise teeth for isolating and scooping up of said animal excrements from said planar surface.

7. The animal excrement collection system of claim 1 wherein said cylindrical shaped open-ended collection receptacle is approximately 8-inches in length and 6-inches in diameter which is sufficiently sized to provide unimpeded movement of said animal excrements through said hollow scooper device into said storage bag.

8. The animal excrement collection system of claim 1 wherein said handle extends an entire length of said cylindrical shaped open-ended collection receptacle.

9. The animal excrement collection system of claim 8 wherein said handle is curved upward to provide a smooth area for said hand of said user to grip during an in-use condition.

10. The animal excrement collection system of claim 1 wherein said at least two fasteners comprise spring-loaded clips for removeably-coupling said storage bag in place and preventing unwanted displacement when scooping up said animal excrements.

11. The animal excrement collection system of claim 1 wherein said at least two fasteners comprise clamps for removeably-coupling said storage bag in place and preventing unwanted displacement when scooping up said animal excrements.

12. The animal excrement collection system of claim 1 wherein said storage bag is disposable with said storage bag being removable from said animal excrement collection system, once filled, and disposed of thereby preventing spread of germs and diseases found in said animal excrements.

13. The animal excrement collection system of claim 12 wherein said storage bag is biodegradable.

14. The animal excrement collection system of claim 13 where said storage bag is approximately 11-inches in width and 14 inches in length dimensioned to fit over said cylindrical shaped open-ended collection receptacle.

* * * * *